US008291514B2

(12) United States Patent
Waters et al.

(10) Patent No.: US 8,291,514 B2
(45) Date of Patent: Oct. 23, 2012

(54) PROTECTIVE GARMENT FOR USE BY A FIREFIGHTER OR OTHER EMERGENCY WORKER AND INCLUDING A BELT TUNNEL

(75) Inventors: Patricia K. Waters, Tipp City, OH (US); Mary I. Grilliot, Dayton, OH (US); William L. Grilliot, Dayton, OH (US); William L. Grilliot, Jr., Dayton, OH (US)

(73) Assignee: Morning Pride Manufacturing, L.L.C., Dayton, OH (US)

( * ) Notice: Subject to any disclaimer, the term of this patent is extended or adjusted under 35 U.S.C. 154(b) by 366 days.

(21) Appl. No.: 12/157,475

(22) Filed: Jun. 11, 2008

(65) Prior Publication Data

US 2009/0307822 A1 Dec. 17, 2009

(51) Int. Cl.
*A62B 17/00* (2006.01)
*A41D 3/02* (2006.01)
*A41F 7/00* (2006.01)

(52) U.S. Cl. ..... 2/81; 2/101; 2/338

(58) Field of Classification Search ..... 2/81, 94, 2/101, 108, 338, 311, 312, 319, 322
See application file for complete search history.

(56) References Cited

U.S. PATENT DOCUMENTS

| | | | | | |
|---|---|---|---|---|---|
| 709,823 | A * | 9/1902 | Mehlfeld | 2/312 |
| 1,147,225 | A * | 7/1915 | Feldman | 2/237 |
| 1,820,918 | A * | 9/1931 | Mackenzie | 24/318 |
| 1,877,697 | A * | 9/1932 | Schlusselberg | 2/93 |
| 2,019,248 | A * | 10/1935 | Blumgardt | 2/93 |
| 2,023,194 | A * | 12/1935 | Dann | 2/93 |
| 2,386,708 | A * | 10/1945 | Morrison | 2/312 |
| 2,443,447 | A * | 6/1948 | Falcon | 2/93 |
| 2,663,027 | A * | 12/1953 | Posson | 2/237 |
| 2,691,172 | A * | 10/1954 | Breslow | 2/312 |
| 2,705,328 | A * | 4/1955 | Felix | 2/312 |
| 3,973,643 | A * | 8/1976 | Hutchinson | 182/3 |
| 4,941,237 | A * | 7/1990 | Hovis | 24/304 |
| 5,036,548 | A * | 8/1991 | Grilliot et al. | 2/81 |
| 5,351,340 | A * | 10/1994 | Aldridge | 2/108 |
| 5,464,136 | A * | 11/1995 | Eddy | 224/666 |
| 5,586,969 | A * | 12/1996 | Yewer, Jr. | 602/19 |
| 5,625,899 | A * | 5/1997 | Snedeker | 2/81 |
| 5,813,051 | A * | 9/1998 | Counter | 2/69 |
| 5,946,724 | A * | 9/1999 | Erickson | 2/93 |
| 5,970,517 | A * | 10/1999 | Jordan | 2/69 |
| 6,012,167 | A * | 1/2000 | De Rosa et al. | 2/94 |
| 6,134,713 | A * | 10/2000 | De Rosa et al. | 2/94 |
| 6,662,372 | B2 * | 12/2003 | Lewis et al. | 2/69 |
| 7,371,951 | B1 * | 5/2008 | Brunzetti | 84/327 |
| 7,596,815 | B2 * | 10/2009 | Grilliot et al. | 2/227 |
| 7,707,660 | B2 * | 5/2010 | Grilliot et al. | 2/455 |
| 7,779,484 | B2 * | 8/2010 | Fee et al. | 2/69 |
| 2002/0029407 | A1 * | 3/2002 | Blechman | 2/311 |

(Continued)

*Primary Examiner* — Alissa L Hoey
(74) *Attorney, Agent, or Firm* — Wood, Phillips, Katz, Clark & Mortimer

(57) ABSTRACT

A protective garment (10) is provided for use by a firefighter or other emergency worker. The garment includes a torso covering portion (20, 50), a belt (24, 54) having a length extending around the torso covering portion, an attachment (25, 56) between the belt and the torso covering portion to limit relative movement of the belt along the length of the belt relative to the torso covering portion, and a belt receiving tunnel (28, 58) on the torso covering portion, the tunnel including a wall portion (40) that is movable between a closed position enclosing the belt in the tunnel and an open position allowing access to the attachment.

20 Claims, 2 Drawing Sheets

U.S. PATENT DOCUMENTS

2003/0188370 A1* 10/2003 Hugh et al. ..... 2/69
2005/0166300 A1* 8/2005 Tanaka ..... 2/108
2006/0277650 A1* 12/2006 Waters et al. ..... 2/81
2007/0044197 A1* 3/2007 Turcotte et al. ..... 2/69
2007/0169246 A1* 7/2007 Sloan et al. ..... 2/81
2007/0192926 A1* 8/2007 Fee et al. ..... 2/81
2007/0199135 A1* 8/2007 Grilliot et al. ..... 2/311
2008/0256678 A1* 10/2008 Grilliot et al. ..... 2/69

* cited by examiner

PROTECTIVE GARMENT FOR USE BY A FIREFIGHTER OR OTHER EMERGENCY WORKER AND INCLUDING A BELT TUNNEL

CROSS-REFERENCE TO RELATED APPLICATIONS

Not Applicable.

FEDERALLY SPONSORED RESEARCH OR DEVELOPMENT

Not Applicable.

MICROFICHE/COPYRIGHT REFERENCE

Not Applicable.

FIELD OF THE INVENTION

This invention relates to protective garments such as those worn by firefighters and other emergency workers.

BACKGROUND OF THE INVENTION

It is common for suspenders or other similar harnesses to be worn with protective garments such as those used by firefighters and other emergency workers. It is also known to utilize a waist belt on the pants or coat of a protective garment in place of suspenders, or as a supplement to suspenders and/or harness. One problem with suspenders, harnesses, and belts is that they can be snagged and/or hang up a firefighter or other rescue worker while they are performing their duties. This is especially problematic during an emergency situation. Another problem, more particularly related to belts, is that the belt can rotate or shift along its length about a wearer's waist relative to the protective garment.

SUMMARY OF THE INVENTION

A protective garment is provided for use by a firefighter or other emergency worker. The garment includes a torso covering portion, a belt having a length extending around the torso covering portion, an attachment between the belt and the torso covering portion to limit relative movement of the belt along the length of the belt relative to the torso covering portion, and a belt receiving tunnel on the torso covering portion, the tunnel including a wall portion that is movable between a closed position enclosing the belt in the tunnel and an open position allowing access to the attachment.

As one feature, the attachment includes hook and loop fasteners on the belt and the torso covering portion.

According to one feature, the attachment includes snap fasteners on the belt and the torso covering portion.

In one feature, the attachment includes stitching.

As one feature, the protective garment further includes a releasable closure to maintain the wall portion in the closed position.

According to one feature, the torso covering portion has a front side and a back side and the wall portion is located centrally on the back side.

In one feature, the tunnel has a length extending around the torso covering portion and the wall portion extends over a limited portion of the tunnel length. As a further feature, the wall portion extends over a minority of the tunnel length.

In accordance with one feature of the invention, a protective garment is provided for use by a firefighter or other emergency worker. The garment includes a torso covering portion, and a belt receiving tunnel on the torso covering portion, the tunnel including a wall portion that is movable between a closed position and an open position allowing access to an attachment for connecting a belt received in the tunnel to the torso covering portion.

As one feature, the protective garment further includes a hook and loop fastener on the torso covering portion within the tunnel and accessible with the wall portion in the open position.

In one feature, the protective garment further includes a snap fasteners on the belt torso covering portion within the tunnel and accessible with the wall portion in the open position.

According to one feature, the protective garment further includes a belt extending through the tunnel and attached within the tunnel to the torso covering portion.

As one feature, the protective garment further includes a releasable closure to maintain the wall portion in the closed position.

According to one feature, the torso covering portion has a front side and a back side and the wall portion is located centrally on the back side.

In one feature, the tunnel has a length extending around the torso covering portion and the wall portion extends over a limited portion of the tunnel length. As a further feature, the wall portion extends over a minority of the tunnel length.

Other objects, features, and advantages of the invention will become apparent from a review of the entire specification, including the appended claims and drawings.

DETAILED DESCRIPTION OF THE PREFERRED EMBODIMENT

Figure 1:
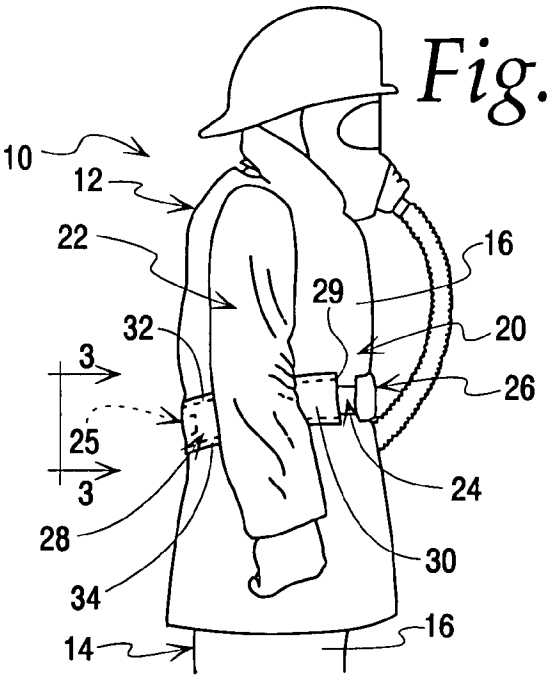
FIG. 1 is a partial perspective view from the side of a firefighter or other emergency worker wearing protective garments embodying the present invention.
Figure 2:
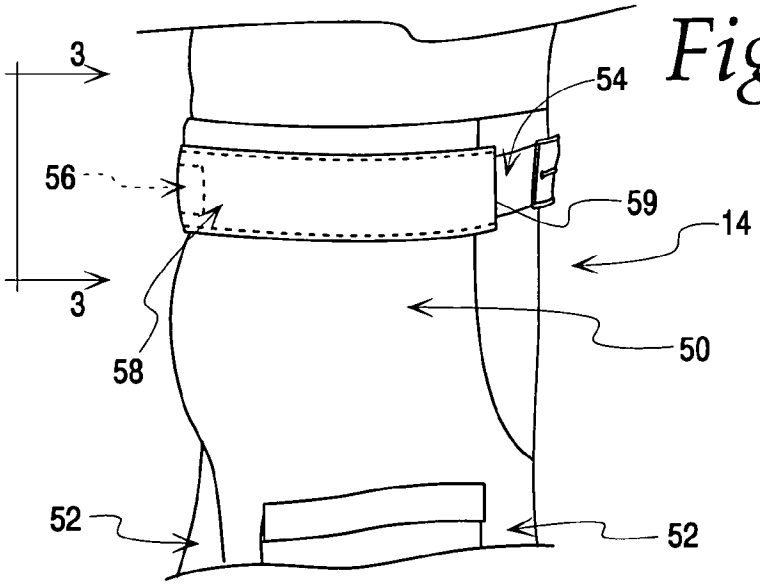
FIG. 2 is a partial perspective view from the side of a firefighter or other emergency worker wearing a protective garment in the form of protective pants embodying the present invention.

With reference to FIGS. 1 and 2, a firefighter or other emergency worker is shown wearing protective garments 10 in the form of a coat 12 and a pair of pants or overalls 14. Preferably, the protective garments conform to one or more National Fire Protection Association (NFPA) standards, for example as exemplified in any editions of NFPA 1971; NFPA 1976; NFPA 1951 USAR; NFPA 1977; NFPA 1999 EMS; and/or NFPA 1991, 1992, 1994 HAZMAT; the disclosures of which are incorporated herein by reference.

Both the coat 12 and the pants 14 are preferably of a multi-layered construction consisting of an outer shell 16, a moisture barrier liner, and a thermal insulating barrier liner or layer, with each of the layers being made from suitable fabrics for each of their particular functions, many of which are known. For example, the outer shell 16 can be made from any suitable fire resistant, thermal resistant and/or wear resistant (i.e., resistant to cuts, snags, tears, and abrasions) material, some examples of which include Kevlar®, Nomex®, Basofil, PBI (polybenzimidazole), and PBO (poly(p-phenylene-benzobisoxazole)) materials. The moisture barrier liner can be made of any suitable material that will be highly resistant to passage of liquid, particularly liquid water, through the material, some examples of which include Crosstech® material (breathable) or Neoprin® (non-breathable). Additionally, the moisture barrier materials can be highly resistant to chemicals so that they also act as a chemical barrier. One example of this material is supplied by W. L. Gore & Associates, Inc. under the CHEMPAK® trademark. The thermal insulative liner can be made of a suitable thermal insulating material or construction, such as nonwoven batting, closed cell foam, and/or Basofil/Aramid batting sandwiched between face layers of a suitable breathable fabric. Additional layers, such as absorbitive layers may also be included in the protective garments 10. Furthermore, while a multi-layered construction is preferred, in some applications, it may be desirable for the protective garments to just include the outer shell 16.

As best seen in FIG. 1, the coat 12 includes a torso-covering portion 20, a pair of limb covering portions in the form of sleeves 22 (only one shown in FIG. 1) extending from the torso-covering portion 20, a waist belt 24 having a length extending completely around the torso-covering portion 20, an attachment shown diagrammatically at 25 between the belt 24 and the torso-covering portion 20 to limit movement of the belt 24 relative to the torso-covering portion 20 along the length of the belt 24. The belt 24 can be of any suitable construction, many of which are known, such as for example a strap of leather and/or a non-elastic web having ends that attach to each other with a suitable adjustable buckle or connector 26 that will allow the belt to be tightened about the waist and/or torso of a wearer. Furthermore, in one preferred embodiment, a portion of the belt 24 to which the attachment 25 is fixed can be made from an elastic strip of material that will allow the belt 24 to stretch with the movements of a wearer. Alternatively, other portions of the belt 24 can be made from an elastic strip of material to provide the same function.

Figure 3B:
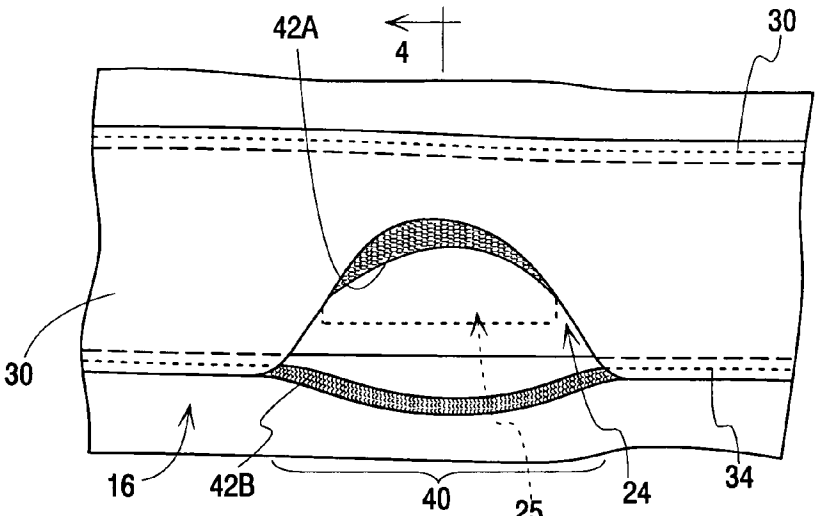
FIGS. 3A and 3B are enlarged views taken from line 3-3 in either of FIGS. 1 and 2 showing a first and second state, respectively, of a belt tunnel of the garments shown in FIGS. 1 and 2.
Figure 3A:
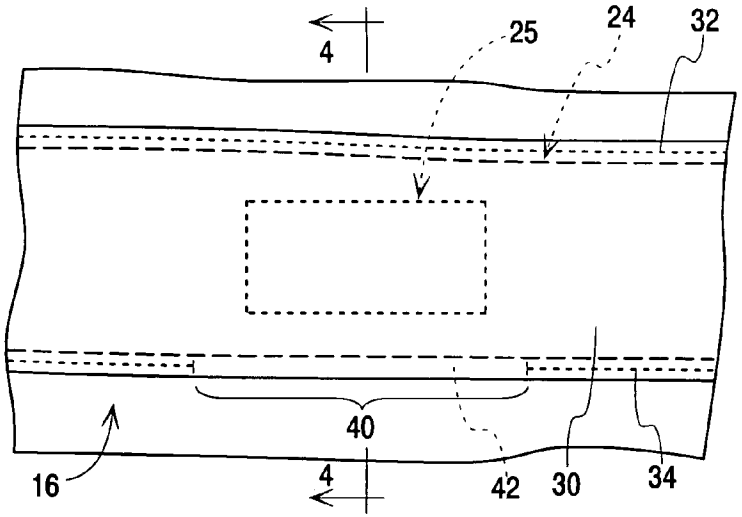

The coat 12 also includes a belt-receiving tunnel 28 permanently fixed to the torso-covering portion 20. The tunnel 28 extends around the torso-covering portion 20 between a pair of openings or mouths 29 (only one shown in FIG. 1) that are equally spaced on opposite sides of the of torso covering portion 20, with the mouths 29 preferably being sized to allow entry and exit of at least one end of the belt 24 to allow the belt 24 to be inserted and removed from the tunnel 28. It is also preferred that the mouths 29 be spaced from each other by a sufficient distance over the front of the torso covering portion 20 to allow for the buckle or connector 26 to be manipulated by the wearer in the exposed space between the mouths 29. As best seen in FIGS. 3A-4B, the tunnel 28 includes an outer wall 30 that is permanently attached to the outer shell 16 over the length of the tunnel 28 by top and bottom, in this embodiment by stitched seams 32 and 34 that extend between the mouths 29 over the length of the wall 30 so that the tunnel 28 has a length extending around the torso-covering portion 20 and a width between the seams 32, 34. The belt 24 has a width that occupies a majority of the width of the tunnel 28. The belt 24 is captively held between the outer wall 30 and torso covering portion 20 at locations around a wearer's torso. While the wall 30 can be made of any suitable material, in a preferred embodiment the wall 30 is made from the same type of material as the outer shell 16. As best seen in FIGS. 3A and 3B, the outer wall 30 of the tunnel 28 includes a portion 40 wherein the bottom seam 34 has been interrupted to allow the portion 40 to be movable between a closed position shown in FIG. 3A enclosing the belt 24 in the tunnel 28 and an open position shown in FIG. 3B allowing access to the attachment 25 so that the attachment 25 can be disconnected. Preferably, a releasable closure 42 is provided to maintain the wall portion in the closed position. In this regard, any suitable releasable closure can be utilized, such as, for example, one or more snap fasteners (not shown) or hook and loop closures, such as hook and loops strips 42A and 42B, shown in FIGS. 3B and 4B fixed to the portion 40 and the outer shell 16, respectively.

Figure 6:
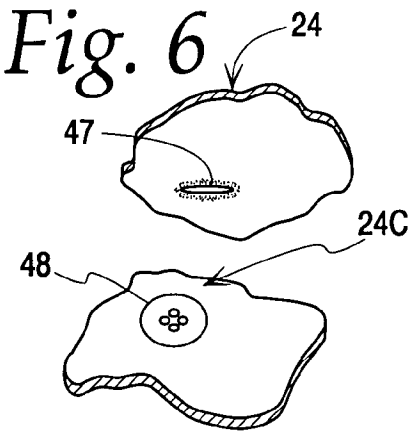
FIGS. 5 through 7 are enlarged views showing various embodiments of an attachment used in the invention.
Figure 5:
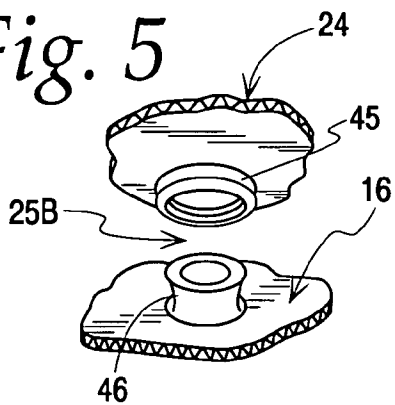
Figure 7:
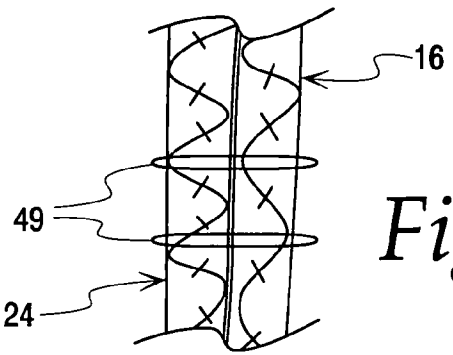
Figure 4B:
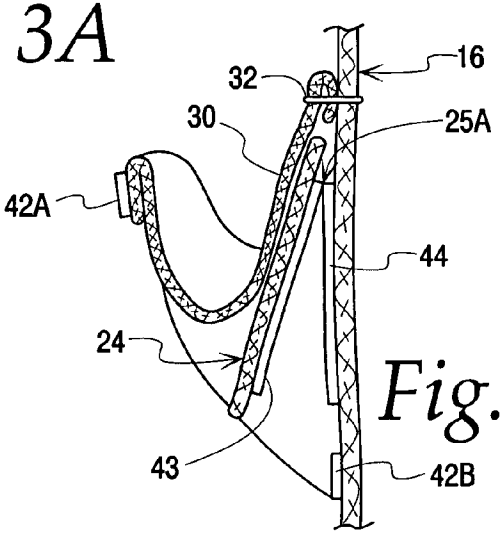
FIGS. 4A and 4B are enlarged section views taken along line 4-4 in FIGS. 3A and 3B.
Figure 4A:
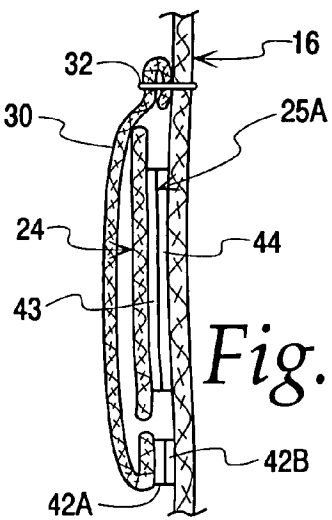

The attachment 25 can be any suitable attachment, such as, for example, one or more hook and loop closure(s) 25A such as shown in FIGS. 4A and 4B with one hook and loop strip or patch 43 fixed to the belt 24 and a mating hook and loop strip or patch 44 fixed to the outer shell 16, one or more snap fastener(s) 25B such as shown in FIG. 5 with one snap component 45 fixed to the belt 24 and the mating snap component 46 fixed to the outer shell 16, or one or more button type connectors 25C with a such as shown in FIG. 6 with a button hole 47 in the belt 24 and a button 48 fixed on the outer shell 16 , or stitching 49 such as shown in FIG. 7. The attachment 25 is centered between the sides of the garment and at the back thereof with the garment worn by a user.

With reference to FIG. 2, the pants 14 includes a torso-covering portion 50, a pair of limb covering portions in the form of legs 52 extending from the torso-covering portion 50, a belt 54 having a length extending completely around the torso-covering portion 50, an attachment shown diagrammatically at 56 between the belt 54 and the torso-covering portion 50 to limit relative movement of the belt 54 along the length of the belt 54 relative to the torso-covering portion 50, and a belt-receiving tunnel 58 on the torso-covering portion 50 extending between openings or mouths 59 (only one shown in FIG. 2) that are equally spaced on opposite sides of the of torso covering portion 50. The details of the belt 54, attachment 56 and tunnel 58 are the same as described above for the belt 24, attachment 25, and tunnel 28 in connection with the coat 12. Accordingly, for the sake of brevity, the details of their construction will not be repeated herein.

It should be understood that, while both the coat 12 and the pants 14 are shown with the belts 24 and 54 and belt tunnels 28 and 58, it may be desirable in applications for only the pants 14 or the coat 12 to include a belt and associated belt tunnel.

It should be appreciated that the belt tunnels 28 and 58 limit the exposure of the belts 24 and 54, thereby limiting the possibility that the belts 24 and 54 will be snagged or hang-up a wearer during the performance of the wearer's duties. Furthermore, by providing the wall portion 40 that is movable between open and closed positions, the attachments 25 and 56 can be disconnected to allow the belts 24 and 54 to be removed for cleaning, maintenance, and/or replacement.

The invention claimed is:

1. A protective garment for use by a firefighter or other emergency worker, the garment comprising:

an outer shell having a torso covering portion with an inner surface and an outer surface;

a belt having a width and a length extending around the outer surface of the torso covering portion;

an attachment cooperating between the belt and the outer surface of the torso covering portion to limit movement of the belt along the length of the belt relative to the torso covering portion; and a belt receiving tunnel on the torso covering portion, the tunnel including an outer wall that is permanently fixed to the outer surface of the torso covering portion, the outer wall having a wall portion that is movable between a closed position enclosing the belt in the tunnel and an open position allowing access to the attachment, wherein the belt resides: a) outside of the outer surface of the torso covering portion; and b) captively between the outer wall and the outer surface of the torso covering portion at locations around a wearer's torso, wherein the tunnel has a length extending around the torso covering portion and a width and the width of the belt occupies a majority of the width of the tunnel.

2. The protective garment of claim 1 wherein the attachment comprises hook and loop fasteners on the belt and the torso covering portion with the belt tightened around a wearer.

3. The protective garment of claim 1 wherein the attachment comprises snap fasteners on the belt and the torso covering portion with the belt tightened around a wearer.

4. The protective garment of claim 1 wherein the attachment comprises stitching.

5. The protective garment of claim 1 further comprising a releasable closure to maintain the wall portion in the closed position.

6. The protective garment of claim 1 wherein the torso covering portion has a front side and a back side and the wall portion is located centrally on the back side.

7. The protective garment of claim 1 wherein the attachment comprises fasteners, one each on the belt and outer surface of the torso covering portion that cooperate with the belt tightened about a wearer.

8. A protective garment for use by a firefighter or other emergency worker, the garment comprising:

an outer shell having a torso covering portion with an inner surface and an outer surface;

a belt having a length extending around the torso covering portion;

an attachment cooperating between the belt and the outer surface of the torso covering portion to limit movement of the belt along the length of the belt relative to the torso covering portion; and a belt receiving tunnel on the torso covering portion, the tunnel including an outer wall that is permanently fixed to the outer surface of the torso covering portion, the outer wall having a wall portion that is movable between a closed position enclosing the belt in the tunnel and an open position allowing access to the attachment, wherein the belt resides: a) outside of the outer surface of the torso covering portion; and b) captively between the outer wall and the outer surface of the torso covering portion at locations around a wearer's torso, wherein the tunnel has a length extending around the torso covering portion and the wall portion extends over a limited portion of the tunnel length.

9. The protective garment of claim 8 wherein the wall portion extends over a minority of the tunnel length.

10. A multi-layered protective garment for use by a firefighter or other emergency worker, the garment comprising:

an outer shell having a torso covering portion with inner and outer surfaces, a moisture barrier liner and an inner thermal insulating barrier liner/layer, the moisture barrier liner residing between the inner surface of the outer shell and the inner thermal insulating barrier liner/layer; and a belt receiving tunnel on the torso covering portion, the tunnel including an outer wall permanently fixed to the torso covering portion, the outer wall having a wall portion that is movable between a closed position enclosing in the tunnel and an open position allowing access to an attachment for connecting a belt received in the tunnel to the torso covering portion, the attachment cooperating between the belt and the outer surface of the torso covering portion, wherein the belt has a length and width and resides: a) outside of the outer surface of the torso covering portion; and b) captively between the outer wall and the outer surface of the torso covering portion at locations around a wearer's torso.

11. The protective garment of claim 10 further comprising a hook and loop fastener on the torso covering portion within the tunnel and accessible with the wall portion in the open position.

12. The protective garment of claim 10 further comprising a snap fasteners on the torso covering portion within the tunnel and accessible with the wall portion in the open position.

13. The protective garment of claim 10 further comprising a belt extending through the tunnel and attached within the tunnel to the torso covering portion.

14. The protective garment of claim 10 further comprising a releasable closure to maintain the wall portion in the closed position.

15. The protective garment of claim 10 wherein the torso covering portion has a front side and a back side and the wall portion is located centrally on the back side.

16. The protective garment of claim 10 wherein the attachment comprises fasteners, one each on the belt and outer surface of the torso covering portion that cooperate with the belt tightened about a wearer.

17. The protective garment of claim 10 wherein the tunnel has a length extending around the torso covering portion and a width and the width of the belt occupies a majority of the width of the tunnel.

18. A protective garment for use by a firefighter or other emergency worker, the garment comprising:

an outer shell having a torso covering portion with inner and outer surfaces; and a belt receiving tunnel on the torso covering portion, the tunnel including an outer wall permanently fixed to the torso covering portion, the outer wall having a wall portion that is movable between a closed position enclosing in the tunnel and an open position allowing access to an attachment for connecting a belt received in the tunnel to the torso covering portion, the attachment cooperating between the belt and the outer surface of the torso covering portion, wherein the belt resides: a) outside of the outer surface of the torso covering portion; and b) captively between the outer wall and the outer surface of the torso covering portion at locations around a wearer's torso, wherein the tunnel has a length extending around the torso covering portion and the wall portion extends over a limited portion of the tunnel length.

19. A protective garment for use by a firefighter or other emergency worker, the garment comprising:

an outer shell having a torso covering portion with inner and outer surfaces; and a belt receiving tunnel on the torso covering portion, the tunnel including an outer wall permanently fixed to the torso covering portion, the outer wall having a wall portion that is movable between a closed position enclosing in the tunnel and an open position allowing access to an attachment for connecting a belt received in the tunnel to the torso covering portion, the attachment cooperating between the belt and the outer surface of the torso covering portion, wherein the belt resides: a) outside of the outer surface of the torso covering portion; and b) captively between the outer wall and the outer surface of the torso covering portion at locations around a wearer's torso, wherein the wall portion extends over a minority of the tunnel length.

20. A protective garment for use by a firefighter or other emergency worker, the garment having a front and back and spaced sides, the garment comprising:

an outer shell having a torso covering portion with an inner surface and an outer surface;

a belt having a width and a length extending around the outer surface of the torso covering portion;

an attachment cooperating between the belt and the outer surface of the torso covering portion to limit movement of the belt along the length of the belt relative to the torso covering portion, the attachment comprising fasteners, one each on the belt and outer surface of the torso covering portion that cooperate with the belt tightened around a wearer, the attachment residing at the back of the garment centered between the spaced sides of the garment; and a belt receiving tunnel on the torso covering portion, the tunnel including an outer wall that is permanently fixed to the outer surface of the torso covering portion, the outer wall having a wall portion that is movable between a closed position enclosing the belt in the tunnel and an open position allowing access to the attachment, wherein the belt resides: a) outside of the outer surface of the torso covering portion; and b) captively between the outer wall and the outer surface of the torso covering portion at locations around a wearer's torso.

* * * * *